US007856738B2

(12) United States Patent
Camacho-Pantoja

(10) Patent No.: US 7,856,738 B2
(45) Date of Patent: Dec. 28, 2010

(54) HYGIENIC TOOTHBRUSHING METHOD

(76) Inventor: Jose A. Camacho-Pantoja, 179 W. Broad St., Stamford, CT (US) 06902

( * ) Notice: Subject to any disclaimer, the term of this patent is extended or adjusted under 35 U.S.C. 154(b) by 0 days.

(21) Appl. No.: 12/347,057

(22) Filed: Dec. 31, 2008

(65) Prior Publication Data

US 2009/0166232 A1 Jul. 2, 2009

Related U.S. Application Data

(62) Division of application No. 11/048,580, filed on Feb. 1, 2005, now abandoned.

(51) Int. Cl.
*F26B 3/02* (2006.01)

(52) U.S. Cl. ..... 34/511

(58) Field of Classification Search ..... 34/511, 34/237–239; 211/65, 126.1, 133.5; 422/292, 422/297

See application file for complete search history.

(56) References Cited

U.S. PATENT DOCUMENTS

| | | | | |
|---|---|---|---|---|
| 1,102,284 | A | | 7/1914 | Miller |
| 1,486,957 | A | | 3/1924 | England |
| 1,696,706 | A | | 12/1928 | Athon |
| 1,708,423 | A | | 4/1929 | Macshane |
| 1,448,231 | A | | 3/1932 | Morrison |
| 1,959,600 | A | | 5/1934 | Schneider et al. |
| 1,987,472 | A | | 1/1935 | Feldon |
| 1,995,972 | A | | 3/1935 | Ehrlich |
| 2,592,131 | A | | 4/1949 | Farrar |
| 2,553,723 | A | | 5/1951 | Perna |
| 2,987,194 | A | * | 6/1961 | Burge ..... 211/65 |
| 3,100,842 | A | | 8/1963 | Tellefsen |
| 3,172,569 | A | | 3/1965 | Wolford |
| 3,881,868 | A | | 5/1975 | Duke |
| 3,884,635 | A | | 5/1975 | Sloan |
| 3,904,362 | A | | 9/1975 | DiPaolo |
| 4,473,152 | A | | 9/1984 | Jump et al. |
| 4,585,119 | A | | 4/1986 | Boyington |
| 4,845,859 | A | | 7/1989 | Evans |
| 4,915,219 | A | | 4/1990 | Ottimo |
| 5,035,385 | A | | 7/1991 | Markham |
| 5,566,823 | A | | 10/1996 | Summers |
| D424,855 | S | | 5/2000 | Murphy |
| 6,171,559 | B1 | | 1/2001 | Sanders et al. |
| 6,186,324 | B1 | | 2/2001 | Catterson |
| 6,360,884 | B1 | | 3/2002 | Smith et al. |
| 6,530,502 | B2 | | 3/2003 | Neal |
| 6,702,113 | B2 | | 3/2004 | Marino |
| 2003/0115694 | A1 | | 6/2003 | Pace |

* cited by examiner

*Primary Examiner*—Jiping Lu
(74) *Attorney, Agent, or Firm*—St. Onge Steward Johnston & Reens LLC

(57) ABSTRACT

A method for sanitizing a toothbrush using a receptacle having a plurality of openings, a plurality of toothbrushes to be removably retained in the receptacle, where the toothbrushes are arranged for each cycle of use so that a dry toothbrush is always available for use and replaced after use within the receptacle in a different arrangement from the rest and allowed to be dried for a sufficient period to kill and prevent bacterial proliferation prior to its reuse in a subsequent cycle of use.

19 Claims, 2 Drawing Sheets

AXONOMETRIC VIEW

PLAN VIEW

AXONOMETRIC VIEW

HYGIENIC TOOTHBRUSHING METHOD

CROSS-REFERENCE TO RELATED APPLICATIONS

This application is a Divisional of U.S. patent application Ser. No. 11/048,580, filed Feb. 1, 2005 now abandoned, which application is currently pending and which application is hereby incorporated by reference herein in its entirety.

FIELD OF THE INVENTION

The present invention relates to a multiple toothbrush holder method for the promotion of oral hygiene. More particularly the present invention relates to an apparatus and method to minimize bacterial growth and cross contamination of toothbrushes which will improve oral hygiene and minimize the frequency and severity of the infections whose port of entry is the oral cavity.

BACKGROUND OF THE INVENTION

The oral and nasal cavities are frequent ports of entry for many local and/or systemic infections caused by fungi, viruses and bacteria. The purpose of routine oral hygiene is to reduce the number of these germs and thereby reducing the risk of infections. A general principle of microbiology is that a wet environment will have germs present. Most germs require a wet environment to remain viable and to multiply. A wet toothbrush provides a perfect environment for the growth of these germs, therefore, becoming, in of itself, a potential source of tooth decay, gum disease, gingivitis, pharyngeal, gastrointestinal, respiratory or systemic infections with the possibility of bringing about illnesses that could even be life threatening such as pneumonias, strokes and heart attacks. These infections can be transferred to another member or members of the family by cross contamination which occurs when a contaminated toothbrush gets in contact with one another or on a contaminated surface like the traditional toothbrush holder or the glass where toothbrushes are sometimes kept or on the sink surface where they sometimes lay. These surfaces are almost always wet and therefore infected. There are many other ways in which a toothbrush can become contaminated which will not be discussed here. For the purposes of this invention, what is to be discussed here, is how to reduce the contamination of toothbrushes regardless of the origin of the contamination in order to reduce the frequency of oro-pharyngeal or systemic infections which are the cause of the loss of millions of man work hours every year.

It is known that reducing the accumulation of bacteria and germs, in a toothbrush, that may be transferred to the mouth during regular use, can aid in oral health. Reducing the bacterial growth within and the contamination of the toothbrush that occurs between uses in daily brushing of the teeth will improve oral hygiene and the overall health of an individual.

During the times in between regular brushing of teeth, bacteria and other germs which can become entrapped in the wet bristles of the toothbrush, accumulate and proliferate in the humid and warm bathroom environment of the bathroom. Toothbrushes can become contaminated with microorganisms such as streptococcus, staphylococcus, and various other periodontal and environmental germs during regular use. While the toothbrush waits for its next use, typically a half-day later, it remains damp or wet. Subsequent rinsing of the toothbrush prior to its use will not remove the bacterias and germs that have proliferated. Traditional toothbrush holders by their design may further foster a wet environment and cause the toothbrush bristles to sit in a wet surface preventing the toothbrush from drying and hence fostering bacterial growth and accumulation. These bacterias and germs will be transferred to the oral cavity during all subsequent uses.

Devices to reduce bacterial contamination in toothbrushes are known. In particular, several existing devices provide a means, in between use, to immerse a toothbrush head into antiseptic liquid (see U.S. Pat. Nos. 1,448,231; 3,904,362; 4,585,119; 4,915,219; 5,566,823; 6,360,884; and 6,702,113) or antiseptic gas or vapor (see U.S. Pat. Nos. 1,486,957; 1,696,706; and 1,708,423). While these devices employ various means to sanitize a toothbrush they are problematic in that they require multiple components, complicated assemblies, and the use of electrical components and/or antiseptics in one form or another, which results in increased costs and decreased portability. These costly assemblies, because of their cumbersome nature, are not easy to use and therefore are not appealing to the general public. There remains a need for our apparatus and method to sanitize toothbrushes simple enough to be appealing to the general public and inexpensive and simple enough to motivate the general public to use it. This will go a long way in improving public health.

SUMMARY OF THE INVENTION

The present invention relates to a method and apparatus for sanitizing and minimizing cross contamination of toothbrushes comprising a receptacle having a plurality of openings and a plurality of toothbrushes, wherein each of said plurality of toothbrushes is received by at least one of the plurality of openings to removably retain and allow to dry each of the plurality of toothbrushes within the receptacle in between each cycle of use.

DETAILED DESCRIPTION OF THE DRAWINGS

Figure 6:
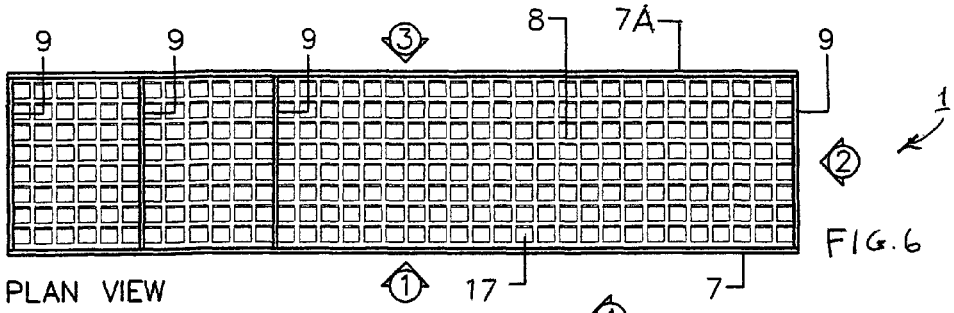
FIG. 6 is a top plan view of the embodiment of FIG. 1.
Figure 1:
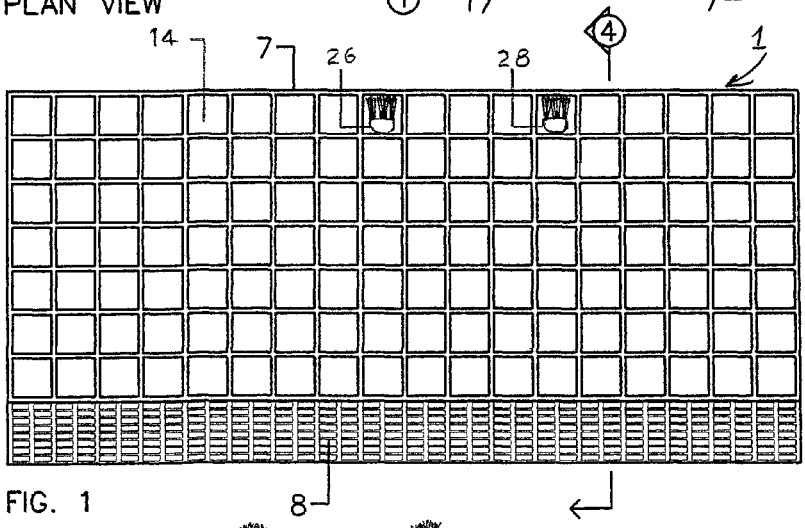
FIG. 1 is a front elevation view of an embodiment of the present invention.
Figure 2:
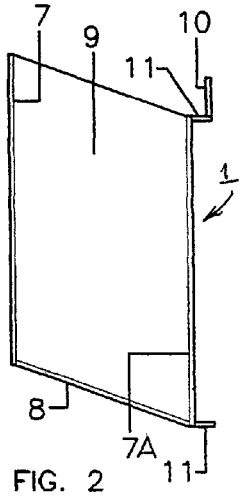
FIG. 2 is a side elevation view of the embodiment of FIG. 1.
Figure 3:
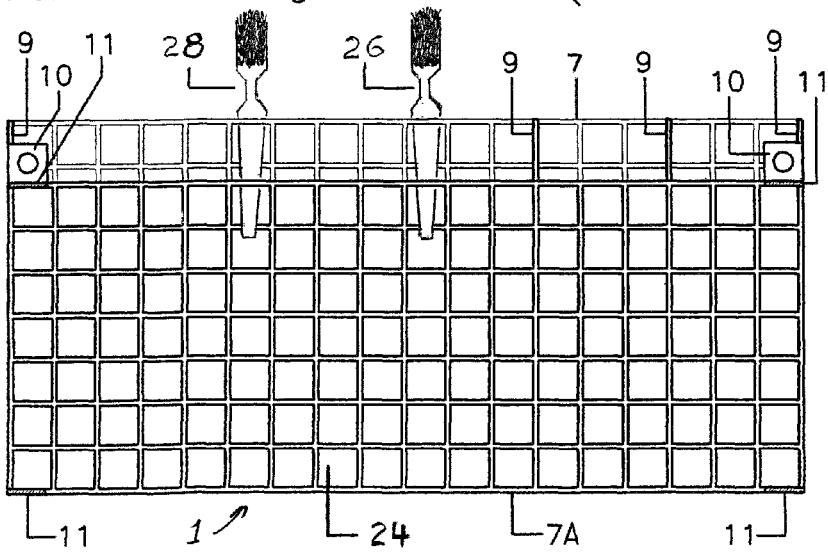
FIG. 3 is a rear elevation view of the embodiment of FIG. 1.
Figure 4:
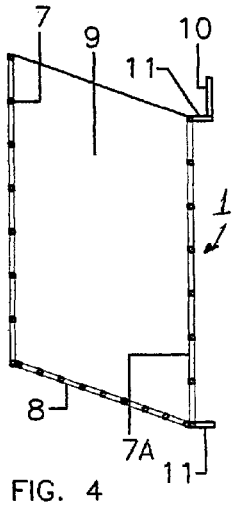
FIG. 4 is a cross-sectional view of the embodiment of FIG. 1 along the line 4 of FIG. 1.

Referring now to FIGS. 1-6, a multiple toothbrush holder apparatus is generally shown at 1 and consists of a receptacle 12 having a front 7 defining a first substantially vertical plane with a plurality of holes or openings 14 disposed therein, and a back 7A defining a second substantially vertical plane with a plurality of holes or openings 24 disposed therein. A plurality of toothbrushes 26 and 28 are removably received by at least one opening in the front wall 14, and at least one opening in the back wall 24. Connecting the front 7 and the back 7A apparatus 12 is a bottom 8, defining a third horizontal plane at a 20° angle, between the first and second planes extending from the front 7 to the back 7A. Additionally, the horizontal bottom 8 has openings 17 disposed therein. The plurality of openings 14 and 24 may be arranged into a plurality of horizontal rows 40, 42, 44 and a plurality of vertical columns 62, 64 and 66 which provide a plurality of positions for the toothbrushes. In addition, apparatus 12 have at least four substantially perpendicular walls 9 extending between the front vertical plane 7, the back vertical plane 7A and the horizontal bottom wall 8. They also define the 20° angle that exist between the front vertical plane 7 and the back vertical plane 7A. Two of these vertical walls 9 are located one at the right end of the receptacle and the other at the left end of the receptacle respectively. The other two vertical walls are located inside the receptacle 12 oriented in the same manner as the end walls and define the plurality of compartments 20, plainview and FIG. 5.

The term toothbrush used herein refers to any dental cleaning device, that would hold water and be susceptible to the accumulation and/or growth of germs and bacterias. Typically, a toothbrush has bristles at one end used to clean teeth and gum, and mouth. A toothbrush may additionally have a handle at other end, either permanently as one unit or may be removably attached to a handle to allow for replacement of head. For instance, toothbrush may be a removable brush head for placement on an electric toothbrush or any other dental cleaning apparatus.

Figure 5:
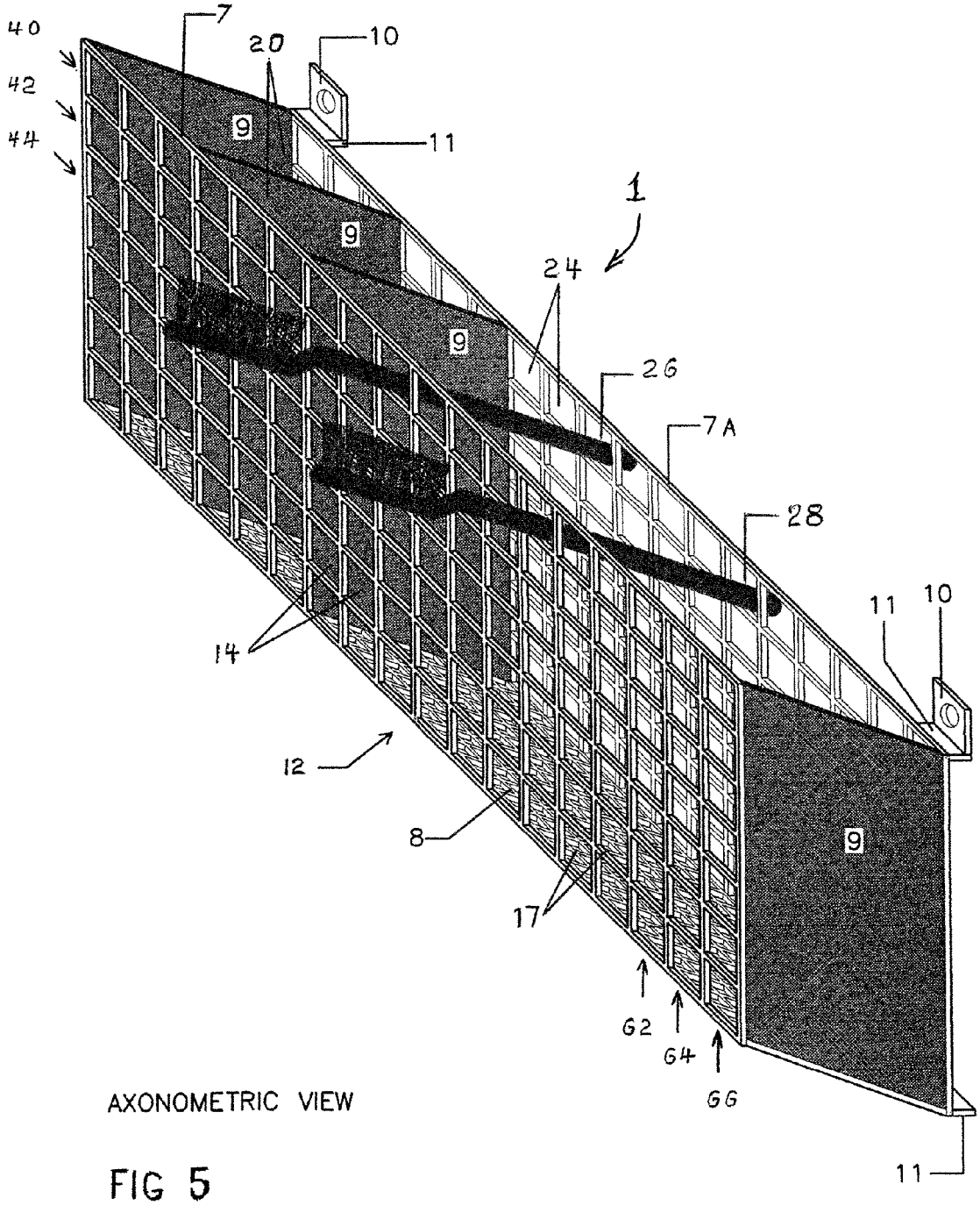
FIG. 5 is a perspective view of the embodiment of FIG. 1

In one aspect of the present invention, each of the plurality of toothbrushes 26 and 28 occupies a position defined by at least one front opening 14 and back opening 24. Preferably, as shown in FIG. 5, each of the plurality of toothbrushes 26 and 28 occupies two openings, one front opening 14 and one back 24 opening at a 20° angle to prevent it from sliding back and falling so that it may be removably secured within receptacle 12. In this respect, one end of each toothbrush 26 and 28 would enter front opening 14, and slide through extending to back 7A of receptacle where it would enter back opening 24 and at least a portion of this one end extending out past back opening 24. The toothbrushes will be arranged in a horizontal manner leaving a space empty between toothbrushes to prevent cross-contamination. A second row of toothbrushes will be arranged likewise but leaving an empty row in between to prevent cross-contamination and in this fashion a total of four rows can be accommodated in the illustrated apparatus which has 12 positions wide by 7 positions high designated to occupy toothbrushes. Of course the apparatus may have any other numbers of positions.

As shown in FIG. 5, additionally, a plurality of side walls 9 may be disposed within receptacle extending substantially from the front 7 to the back 7A and to divide receptacle 12 into a plurality of compartments 20 to allow for storage of related items, such as toothpaste tubes, dental floss, and the like.

According to the present invention, the apparatus and method allows for the first-used toothbrush in the system to remain unused for a sufficient time to fully dry, thus preventing germ or proliferation and accumulation of bacteria prior to re-wetting for subsequent use. This is achieved by providing an additional number of toothbrushes for use during the drying time of the first-used toothbrush. Each cycle of use of the method and apparatus according to the present invention involves use of a toothbrush, followed by a period of nonuse sufficient to permit drying of the toothbrush sufficiently to kill or to reduce the proliferation of retained germs or bacterias in the toothbrush. The period of non use will typically be at least 3 days. Cross-contamination is avoided by preventing the bristles of any one of the toothbrush/toothbrushes from getting in contact with the bristles of any other toothbrush/toothbrushes or from getting in contact with any contaminated surfaces.

In the preferred embodiment, each toothbrush is used once every 2, 3, 4 or 5 days, depending on the number of toothbrushes, which would preferably be 4, 6, 8 or 10.

A preferred embodiment is a 2 day cycle. In a 2 day cycle, assuming the user brushes his or her teeth twice daily, a total of 4 toothbrushes might be used in the invention. In the described cycle, a first toothbrush is used Monday morning then allowed to dry for the next 2 days, a second toothbrush is used on Monday night then allowed to dry for the next 2 days, a third toothbrush is used on Tuesday morning then allowed to dry for the next 2 days, a fourth toothbrush is used on Tuesday night, and the cycle begins again with the first toothbrush. In an alternative version of this embodiment of the invention, the same toothbrush might be used for both morning and nighttime brushings.

Another preferred embodiment is a 3 day cycle. In a 3 day cycle, assuming the user brushes his or her teeth twice daily, a total of 6 toothbrushes might be used in the invention. In the described cycle, a first toothbrush is used Monday morning then allowed to dry for the next 3 days, a second toothbrush is used on Monday night then allowed to dry for the next 3 days, a third toothbrush is used on Tuesday morning then allowed to dry for the next 3 days, a fourth toothbrush is used on Tuesday night, and so forth, until all brushes have been used and the cycle begins again with the first toothbrush. In another embodiment of the invention, the same toothbrush might be used for both morning and nighttime brushings, and thus a weekly cycle would require only seven toothbrushes. Other cycles may be used, depending on the number of positions provided in the apparatus.

In order to keep track of which toothbrush is in the drying stage, and which is ready for use, a cycle marker may be used. For instance, at the start of a cycle, all toothbrushes may have their bristles facing in one direction, such as upward facing or downward facing. The first-used toothbrush once used, will be placed back into the receptacle with its bristles facing in the opposite direction of the remaining toothbrushes, and hence, appearing differently from the remaining unused toothbrushes, noting to the user to select the subsequent toothbrush with bristles facing in the appropriate direction for use the next time user brushes his/her teeth. This consistent orientation ensures that the user selects a dry toothbrush for use during each cycle.

This aspect of the present invention further allows for the use of the apparatus and method by more than one user, for instance, four members of a household. In a six member family, a two day drying cycle could be used. In this case, the four toothbrushes would be arranged vertically leaving a receptacle empty between each toothbrush and a vertical column empty between the toothbrushes of each member. In this aspect of the present invention, different users of the apparatus and method may have their set of toothbrushes occupying a different row or column of the receptacle 7 to distinguish from another's users toothbrushes occupying a different row or column.

Alternatively, toothbrushes of a cycle may occupy a specific row and/or column in order to allow the user to know when a cycle begins and end, noting adequate drying time for first toothbrush of cycle. For instance, at the start of a cycle, all toothbrushes may occupy openings all within a specific row or column, arranging all toothbrushes of the cycle within that row or column. The first-used toothbrush, once used, will be placed back into receptacle within a opening outside of the specific row or column the remaining toothbrushes occupy, and hence, appearing differently from the remaining unused toothbrushes within receptacle, noting to the user to select the subsequent toothbrush in the row or column for use the next time user brushes his/her teeth.

The method of the present invention allows for toothbrush to fully dry with air flowing through the receptacle before it must be re-wet for use again. Allowing for toothbrushes to fully dry and not remain wet, the present invention achieves prevention of bacterial or germ accumulation and growth in toothbrushes. The method and apparatus of the invention thus allows a substantial portion of germs contained in the toothbrush to be killed by drying. Thus as used herein, the word "dry" defines a state of sufficiently reduced moisture to prevent bacterial growth, and more preferably a sufficiently reduced moisture which causes killing of germs. To further enhance this toothbrush drying method once the toothbrush has been used, the user will first rinse the toothbrush and then with the bristles facing down hold the toothbrush by the end of the handle and tap the mid portion of the handle against the edge of the sink two to three times to remove the excess water prior to returning it to the receptacle. To further enhance the sanitizing process it is recommended to immerse the toothbrush in a mouthwash solution for a few minutes every so often.

In another aspect of the present invention, receptacle 12 includes brackets 10, shown in FIGS. 2, 3, 4 and 10 at each of its ends, from which to hang the receptacle or to mount the receptacle to a desired vertical surface, such as the bathroom wall, preferably high enough or away from the sink to prevent contaminated water from the sink from splashing over the toothbrushes. When mounting to a wall, spacers or extensions 11, FIGS. 2, 3, 4, 5, and 11 are provided so that the receptacle does not lie directly against the wall surface, and openings 24 of the receptacle are not hindered from receiving the toothbrushes or the airflow. Extensions 11 may additionally be placed at both top and bottom of back 7A so that the receptacle is mounted with the back 7A substantially parallel to the wall.

Receptacle 12 may be made of any appropriate material which is nonabsorbent and will not hold water to allow for drying of toothbrush. Such materials include but are not limited to plastic, rubber and stainless steel aluminum. The material may be mesh, woven, perforated or otherwise constructed to allow for removable receipt of toothbrushes and passage of air through the receptacle 12. Additionally, the material of the apparatus may include and an antibacterial component or coating to further promote antibacterial properties. In one embodiment of the present invention, technology of this sort may be incorporated into the materials which are used to construct the apparatus of the present invention. For instance, application of an antibacterial coating to the receptacle of the present invention would further inhibit bacterial growth on receptacle and on toothbrushes it holds.

The above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention.

What is claimed is:

1. A method of sanitizing a toothbrush comprising:

providing a receptacle with a plurality of openings;

placing a plurality of toothbrushes for a user within the receptacle, each of the plurality of toothbrushes received by at least one of the plurality of openings to removably retain each of the plurality of toothbrushes within the receptacle; and arranging the plurality of toothbrushes within the receptacle at the beginning of a cycle of use, the arrangement having a first toothbrush which is dry for use;

selecting the first toothbrush for use to begin a cycle of use; and replacing the first toothbrush into the receptacle in a different arrangement from the rest and allowing said toothbrush to be dried before its reuse at the beginning a subsequent cycle of use.

2. The method in accordance with claim 1, further comprising sequentially selecting and using each one of said plurality of toothbrushes subsequent to use of said first toothbrush during said cycle of use; and replacing each one of said plurality of toothbrushes into the receptacle in the same arrangement as said first toothbrush and allowing said toothbrush to be dried before its reuse at the beginning a subsequent cycle of use.

3. The method in accordance with claim 2, wherein each one of said plurality of toothbrushes is allowed to dry a sufficient amount of time to prevent proliferation of bacteria on said plurality of toothbrushes prior to their next use.

4. The method in accordance with claim 1, wherein said first toothbrush is allowed to dry a sufficient amount of time to prevent proliferation of bacteria on said first toothbrush prior to its next use.

5. The method in accordance with claim 1, wherein the receptacle has a front defining a first substantially vertical plane, a back defining a second substantially vertical plane substantially parallel to the first plane, the front and the back having a plurality of openings, and at least one wall defining a third plane substantially perpendicular to the first and second planes, extending from the front to the back.

6. The method in accordance with claim 5, wherein each of the plurality of toothbrushes is received by both one of the plurality of openings of the front and one of the plurality of openings of the back.

7. The method in accordance with claim 1, wherein at any given time at least one of the pluralities of toothbrushes is dry for use to brush teeth.

8. The method in accordance with claim 1, further comprising arranging each of the plurality of toothbrushes in a row along a length of the receptacle at the beginning of each cycle of use, wherein during each cycle of use, each toothbrush removed for use is replaced within the receptacle in an at least one opening that is not within the row so as to distinguish between used and unused toothbrushes within a cycle.

9. The method in accordance with claim 1, comprising arranging each of the plurality of toothbrushes in a consistent orientation within the receptacle at the beginning of each cycle of use, wherein during each cycle of use, each of the plurality of toothbrushes removed for use is replaced within the receptacle in a different orientation from the remaining unused toothbrushes so as to distinguish between used and unused toothbrushes within a cycle.

10. A method of preventing bacterial proliferation on a toothbrush, comprising:

providing a receptacle with a plurality of openings;

placing a plurality of toothbrushes for a user within the receptacle, each of the plurality of toothbrushes received by at least one of the plurality of openings to removably retain each of the plurality of toothbrushes within the receptacle; and arranging the plurality of toothbrushes within the receptacle at the beginning of a cycle of use, the arrangement having a first toothbrush which is dry for use;

selecting the first toothbrush for use to begin a cycle of use; and replacing the first toothbrush into the receptacle in a different arrangement from the rest so as to allow it to fully dry before its reuse in a subsequent cycle.

11. The method in accordance with claim 10, further comprising sequentially selecting and using each one of said plurality of toothbrushes subsequent to use of said first toothbrush during said cycle of use; and replacing each one of said plurality of toothbrushes into the receptacle in the same arrangement as said first toothbrush and allowing said toothbrush to be dried before its reuse at the beginning a subsequent cycle of use.

12. The method in accordance with claim 11, wherein each one of said plurality of toothbrushes is allowed to dry a sufficient amount of time to prevent accumulation of bacteria on said plurality of toothbrushes prior to their next use.

13. The method in accordance with claim 10, wherein said first toothbrush is allowed to dry a sufficient amount of time to prevent accumulation of bacteria on said first toothbrush prior to its next use.

14. The method in accordance with claim 10, wherein the receptacle has a front defining a first substantially vertical plane, a back defining a second substantially vertical plane substantially parallel to the first plane, the front and the back having a plurality of openings, and at least one wall defining a third plane substantially perpendicular to the first and second planes, extending from the front to the back.

15. The method in accordance with claim 14, wherein each of the plurality of toothbrushes is received by both one of the plurality of openings of the front and one of the plurality of openings of the back.

16. The method in accordance with claim 10, wherein at any given time at least one of the pluralities of toothbrushes is dry for use to brush teeth.

17. The method in accordance with claim 10, further comprising arranging each of the plurality of toothbrushes in a row along a length of the receptacle at the beginning of each cycle of use, wherein during each cycle of use, each toothbrush removed for use is replaced within the receptacle in an at least one opening that is not within the row so as to distinguish between used and unused toothbrushes within a cycle.

18. The method in accordance with claim 10, comprising arranging each of the plurality of toothbrushes in a consistent orientation within the receptacle at the beginning of each cycle of use, wherein during each cycle of use, each of the plurality of toothbrushes removed for use is replaced within the receptacle in a different orientation from the remaining unused toothbrushes so as to distinguish between used and unused toothbrushes within a cycle.

19. A method of preventing bacterial proliferation on a toothbrush, comprising:

providing a receptacle with a plurality of openings, wherein the receptacle has a front defining a first substantially vertical plane, a back defining a second substantially vertical plane substantially parallel to the first plane, the front and the back having a plurality of openings, and at least one wall defining a third plane substantially perpendicular to the first and second planes, extending from the front to the back;

placing a plurality of toothbrushes for a user within the receptacle, each of the plurality of toothbrushes received by at least one of the plurality of openings to removably retain each of the plurality of toothbrushes within the receptacle; and said plurality of toothbrushes being arranged in a cycle of use, each toothbrush in said cycle of use having been most recently used at a different time, and each toothbrush being oriented according to its most recent use in a current or a prior cycle of use, said cycle of use being sized to permit each toothbrush therein to dry to prevent accumulation of bacteria thereon prior to the next use thereof.

* * * * *